United States Patent [19]

Maspero

[11] Patent Number: 5,027,559

[45] Date of Patent: Jul. 2, 1991

[54] SHARPENING UNIT FOR LEATHER SPLITTING MACHINES

[75] Inventor: Carlo Maspero, Como, Italy

[73] Assignee: Camoga S.p.A., Milan, Italy

[21] Appl. No.: 347,460

[22] Filed: May 4, 1989

[30] Foreign Application Priority Data

May 6, 1988 [IT] Italy ..... 21193[U]
Apr. 26, 1989 [IT] Italy ..... 20963[U]

[51] Int. Cl.[5] ..... B24B 7/00

[52] U.S. Cl. ..... 51/80 BS; 51/80 R; 51/81 BS; 51/82 BS; 51/83 BS; 51/84 BS; 51/165.81; 83/174; 83/174.1

[58] Field of Search ..... 51/80 R, 80 A, 80 B, 51/80 BS, 81 R, 81 BS, 82 R, 82 BS, 83 BS, 84 BS, 165.81, 246, 274, 285; 83/174, 174.1

[56] References Cited

U.S. PATENT DOCUMENTS 1,060,287 4/1913 Ray ..... 51/80 R
1,870,817 8/1932 Maag et al. ..... 51/285 X
3,395,595 8/1968 Braun et al. ..... 51/246 X
3,772,951 11/1973 Repetto ..... 51/247 X
4,199,901 4/1980 Lefevre ..... 51/83 BS
4,713,950 12/1987 Mascetti ..... 83/174 X

FOREIGN PATENT DOCUMENTS 1477951 4/1969 Fed. Rep. of Germany ..... 51/80 B

*Primary Examiner*—Frederick R. Schmidt
*Assistant Examiner*—M. Rachuba
*Attorney, Agent, or Firm*—Darby & Darby

[57] ABSTRACT

The sharpening unit comprises two diamond grinding wheels 6,7 mounted on respective shafts 8, 9 rotatably supported by a carriage 14 movable away from and towards the cutting blade 4 of a leather splitting machine to bring the grinding wheels in contact with the blade bevel. Said shafts are housed in eccentric bushes 30, 31 rotatably engaged in said carriage and operable in angular rotation, which bushes can be fixed according to predetermined positions to give a desired mutual positioning to said diamond grinding wheels.

8 Claims, 5 Drawing Sheets

SHARPENING UNIT FOR LEATHER SPLITTING MACHINES

FIELD AND BACKGROUND OF THE INVENTION

The present invention relates to a sharpening unit for leather splitting machines.

It is known that for carrying out the splitting of leather and the like, that is in order to perform a transverse cutting along leather sheets and separate a valuable layer having a constant thickness from a less valuable one to be discarded and corresponding to the reverse side of said sheets, particular machines referred to as splitting machines are used, which machines accomplish a leather thinning cut by means of band blades tautened between two pulleys or flywheels.

Due to the fact that leathers to be split are usually very thin in thickness, the band blade must be capable of operating in a very precise manner and consequently the cutting edge or bevel thereof must always be perfectly sharpened. To achieve a perfect sharpening a sharpening unit is provided to be mounted on splitting machines which unit must act continuously, during the machine operation, by means of a pair of grinding wheels symmetrically disposed relative to the blade bevel and in contact therewith.

Grinding wheels conventionally used on leather splitting machines consist of a mixture of abrasive materials with differently sized grains and must be provided with independent adjusting means designed to adjust their positioning in relation to the blade bevel. In greater detail the upper and lower grinding wheels are mounted on respective swinging arms provided with a projection in which a threaded through hole is bored. Operatively engaged with said hole is an adjusting screw the free end of which is designed to abut against a fixed locator element carried by the sharpening unit casing. In this manner, by acting upon one of the adjusting screws it is possible to move the swinging arm supporting the respective grinding wheel as far as the latter reaches the correct positioning relative to the blade bevel.

While the splitting machine is running an operator must intervene rather often on the adjusting means both because it is necessary to have a constant control on the bevel wear and because the operative surface of the grinding wheels must be periodically dressed.

More particularly, the grinding wheel dressing operation brings about a reduction in the diameter of the grinding wheels themselves so that the working surfaces thereof move apart from the cutting blade. Obviously, as a result, it becomes necessary to carry out a resetting of the adjustment.

In order to eliminate the drawbacks resulting from the wear of the working surfaces in grinding wheels which give rise to dirtiness and involve periodical adjusting interventions, in traditional splitting machines grinding units have been used which are provided with diamond grinding wheels, that is particular grinding wheels which, although exerting an excellent abrasive action, are noiseless and subjected to a minimum degree of wear, at all events much more reduced than traditional grinding wheels.

All attempts to use diamond grinding wheels in leather splitting machines have however given poor results, due to a series of inconveniences among which one of the most important is the fact that said diamond grinding wheels are mounted on the same supporting structures as those used for traditional grinding wheels made of abrasive material. In fact, owing to the weak wear of said diamond grinding wheels and to the fact that the adjustment of the lower grinding wheel is independent of that of the upper one, the operator cannot visually see whether both grinding wheels exert their abrasive action on the blade bevel in identical manner and correctly. Practically, in the absence of the characteristic "flashing" caused by the abrasive action of traditional grinding wheels on the blade, the operator cannot realize whether one grinding wheel is working more than the other and consequently whether the bevel is symmetric and is carrying out a correct cutting of the leather. In addition, still due to the independent adjustment of the grinding wheels, the same difficulties as regards positioning and possibilities of repeated positionings as already found in sharpening units provided with traditional grinding wheels, are present here as well.

OBJECTS

The main object of the present invention is to obviate the drawbacks associated with the splitting machines of the known art by providing a sharpening unit for leather splitting machines on which diamond grinding wheels can be mounted, which are capable of carrying out an identical and constant abrasive action both on the upper and lower parts of the cutting blade bevel.

A further object of the present invention is to provide a sharpening unit capable of readily restoring the previous positioning after replacement of the diamond grinding wheels and/or cutting blade.

A still further object of the present invention is to provide a sharpening unit equipped with members adapted to perform a quick positioning of the grinding wheels, that is enabling the ready opening of the grinding wheels at the moment of carrying out the replacement of the cutting blade and the subsequent quick repositioning of the same to the operative condition.

SUMMARY OF THE INVENTION

The foregoing and still further objects that will become more apparent in the following are achieved, according to the present invention, by a sharpening unit for leather splitting machines comprising a pair of diamond grinding wheels disposed symmetrically relative to the bevel of the cutting blade and mounted on respective shafts carried by a carriage horizontally movable close to and apart from said cutting blade, a control-adjustment shaft provided, at one end thereof, with one idler element operatively connected to a second idler element fixedly fitted on an adjusting screw one end of which is screwed in a threaded hole bored in the movable carriage, whereas the opposite end, thrusted by spring means, abuts against a fixed locator element of the splitting machine.

BRIEF DESCRIPTION OF THE DRAWINGS

Further features and advantages of the invention will best be understood from the detailed description of some preferred but not exclusive embodiments of a sharpening unit for leather splitting machines given hereinafter by way of non-limiting example with reference to the accompanying drawings, in which.

DESCRIPTION OF THE PREFERRED EMBODIMENTS

Figures 1, 3:
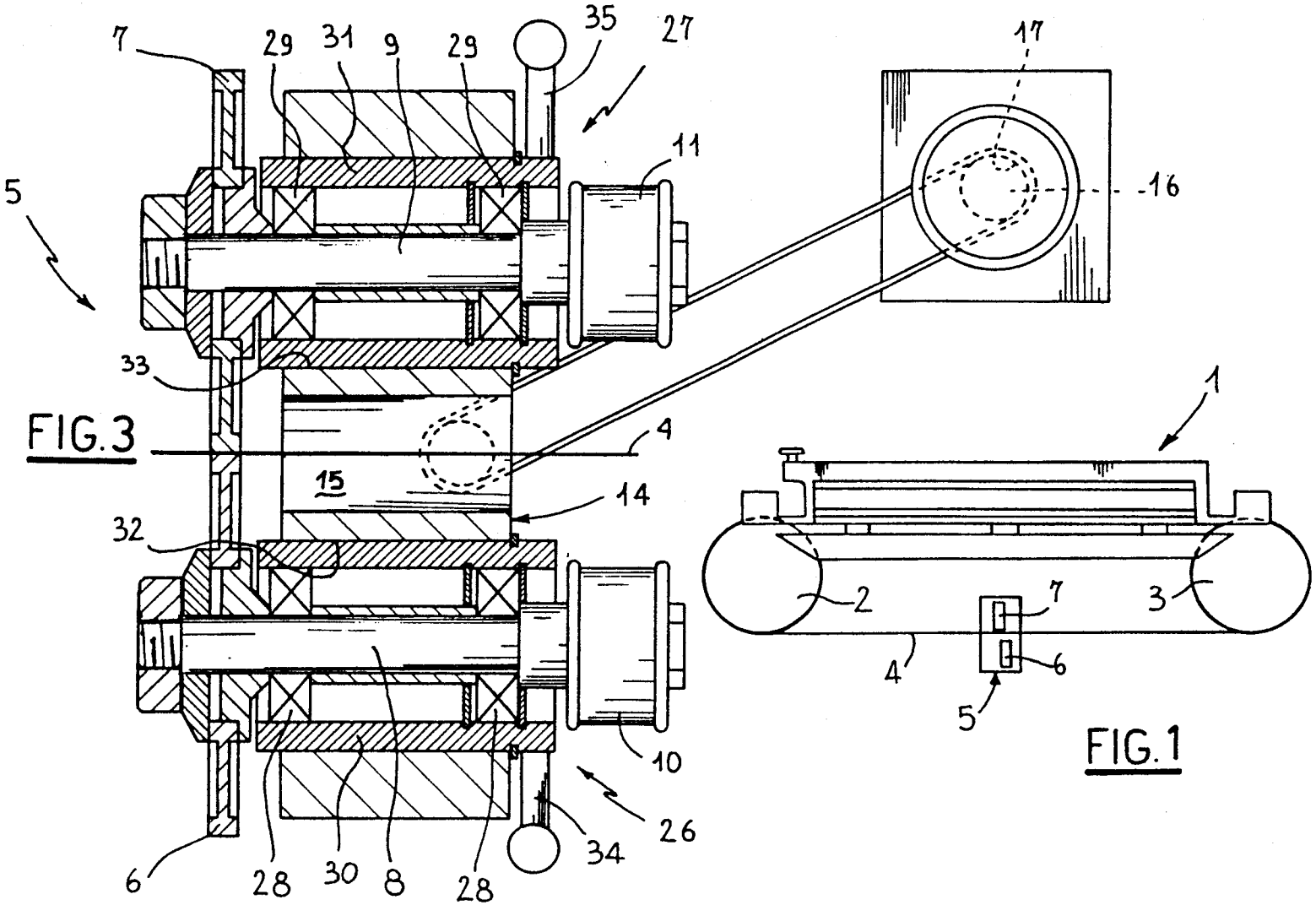
FIG. 1 is a diagrammatic front view to a reduced scale of a leather splitting machine provided with a group of sharpening grinding wheels.
FIG. 3 diagrammatically shows the sharpening unit taken along line III—III in FIG. 2.

Referring to the drawings and in particular to FIG. 1, a splitting machine of a conventional type including a pair of flywheels 2 and 3 around which a band blade 4 is disposed, has been generally identified by reference numeral 1. A sharpening unit in accordance with the present invention and identified at 5, is provided in the region of the lower portion of blade 4.

Figure 2:
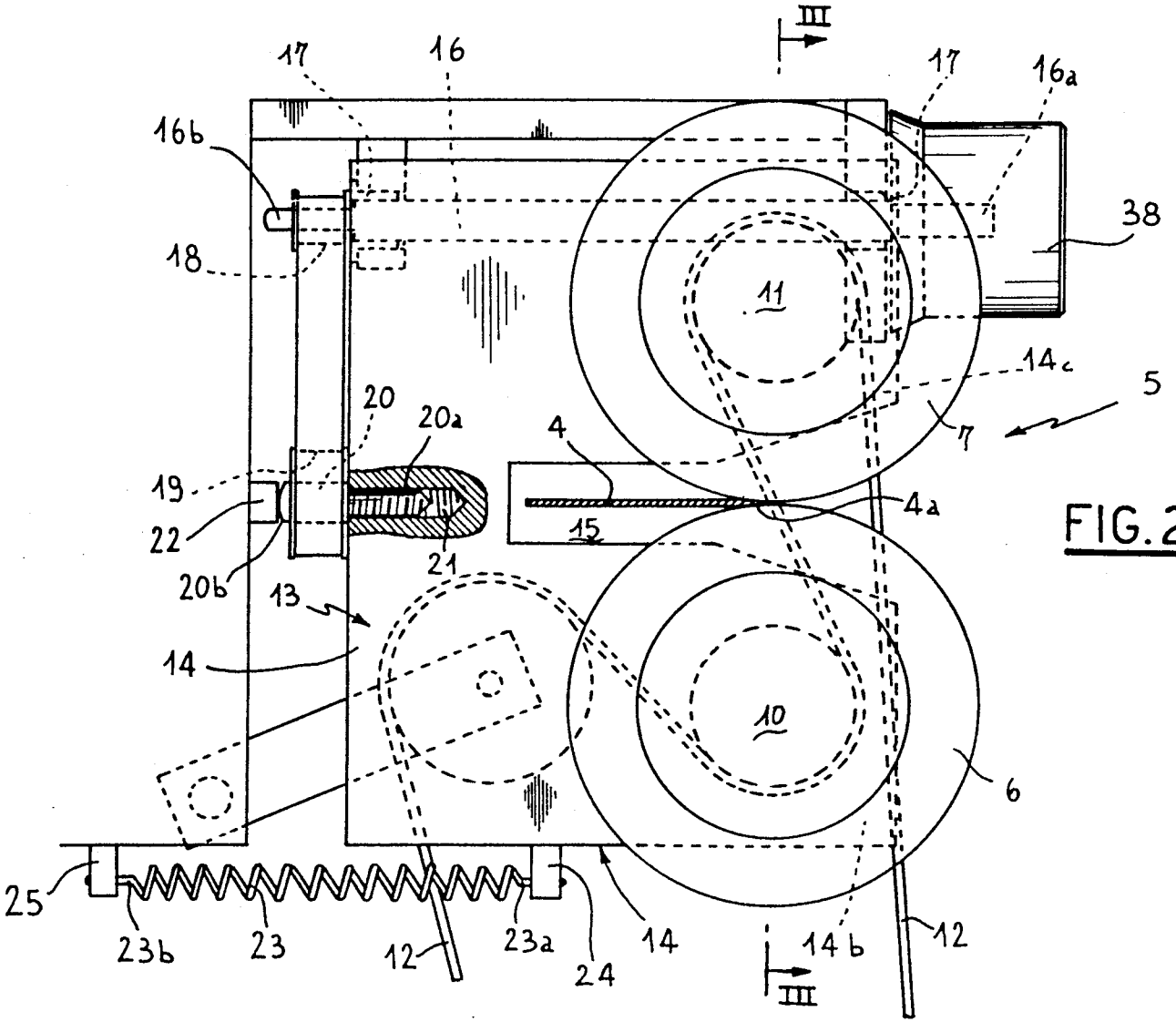
FIG. 2 is a side view taken from the left of the sharpening unit according to one embodiment of the invention.

Referring particularly to FIGS. 2 and 3, the sharpening unit 5 is comprised of a pair of diamond grinding wheels 6, 7 symmetrically disposed relative to the bevel 4*a* of the cutting blade 4.

The grinding wheels 6 and 7 are mounted to one end of respective shafts 8, 9 on the other end of which corresponding pulleys 10 and 11 are fixedly fitted. Operatively engaged in the pulley races is a driving belt 12 operated by a motor not shown in the figures and kept tensioned in a manner known per se and conventional by a takeup pulley 13.

Shafts 8 and 9 are mounted, in a manner to be shown more clearly in the following, on a carriage 14 horizontally movable along guiding rods not shown in the figures and integral with the fixed casing of the splitting machine, from and towards the cutting blade 4. More particularly, the movable carriage 14 is formed with an upright portion 14*a* from which two substantially parallel arms 14*b* and 14*c* project, said arms supporting the shafts 8 and 9 and defining a space 15 through which the cutting blade 4 passes.

Still referring to FIGS. 2 and 3, 16 denotes a control-adjustment shaft which is supported at 17 by the fixed casing of the splitting machine 1 and is provided, at one end 16*a* thereof, with a control-adjustment knob 38 and, at the opposite end, with one idler element 18.

The first idler element 18 is operatively connected to a second idler element 19 fixedly fitted on an adjusting screw 20. As clearly shown in FIG. 2, the adjusting screw 20 has one end 20*a* screwed in a threaded hole 21 bored in the portion 14*a* of the movable carriage 14 and the opposite end 20*b* in abutment against a fixed locator element 22 integral with the splitting machine casing. In order to keep the end 20*b* of screw 20 urged against the fixed locating element 22 spring means is provided which consists for example of at least a pulling spring 23 one end 23*a* of which is fastened at 24 to the carriage 14 and the opposite end 23*b* is secured at 25 to the fixed casing of the splitting machine.

Idler elements 18 and 19 in a preferred embodiment are formed either with ring gears connected to each other by a chain or with pulleys operatively connected by a belt.

The sharpening unit 5 is further provided, for each grinding wheel 6 and 7, with rapid-positioning means generally identified at 26 and 27. According to this means, in order to achieve the rapid positioning of the grinding wheels 6 and 7 the respective shafts 8 and 9 must be rotatably housed, with the interposition of pairs of bearings 28 and 29, inside respective eccentric bushes 30 and 31 rotatably supported within housings 32 and 33 formed in the movable carriage 14. Bushes 30 and 31 are fixedly associated with control levers 34 and 35 which, being acted upon, cause the rotation of the bushes about their own axis so that, as a result, the grinding wheels 6 and 7 rapidly move apart from or close to their working position.

Also associated with the eccentric bushes 30, 31 is stop means intended to stop the angular rotation of the control levers 34, 35 and therefore of the eccentric bushes themselves, in order to give a predetermined positioning to the diamond grinding wheels 6, 7. In the embodiment shown in FIGS. 4 and 5 said stop means merely comprises two limit locators 36, 37 for levers 34, 35. As clearly seen in FIG. 5, when levers 34 and 35 are in abutment against the limit locators 36 and 37, the grinding wheels 6 and 7 are in their working condition for sharpening the cutting blade.

Figure 7:
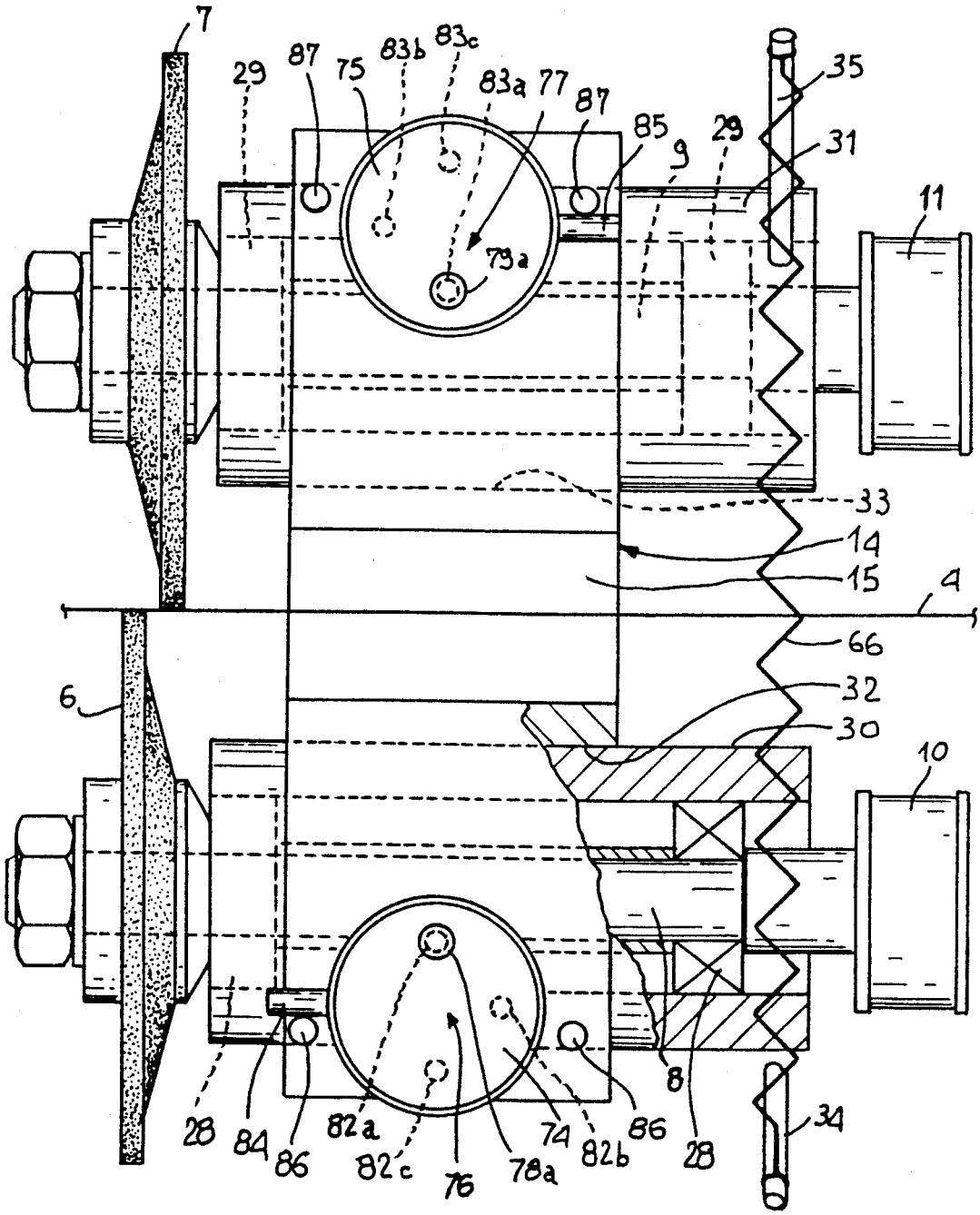
FIG. 7 is a front view of the sharpening unit disposed in the same condition as viewed in FIG. 6.
Figure 8:
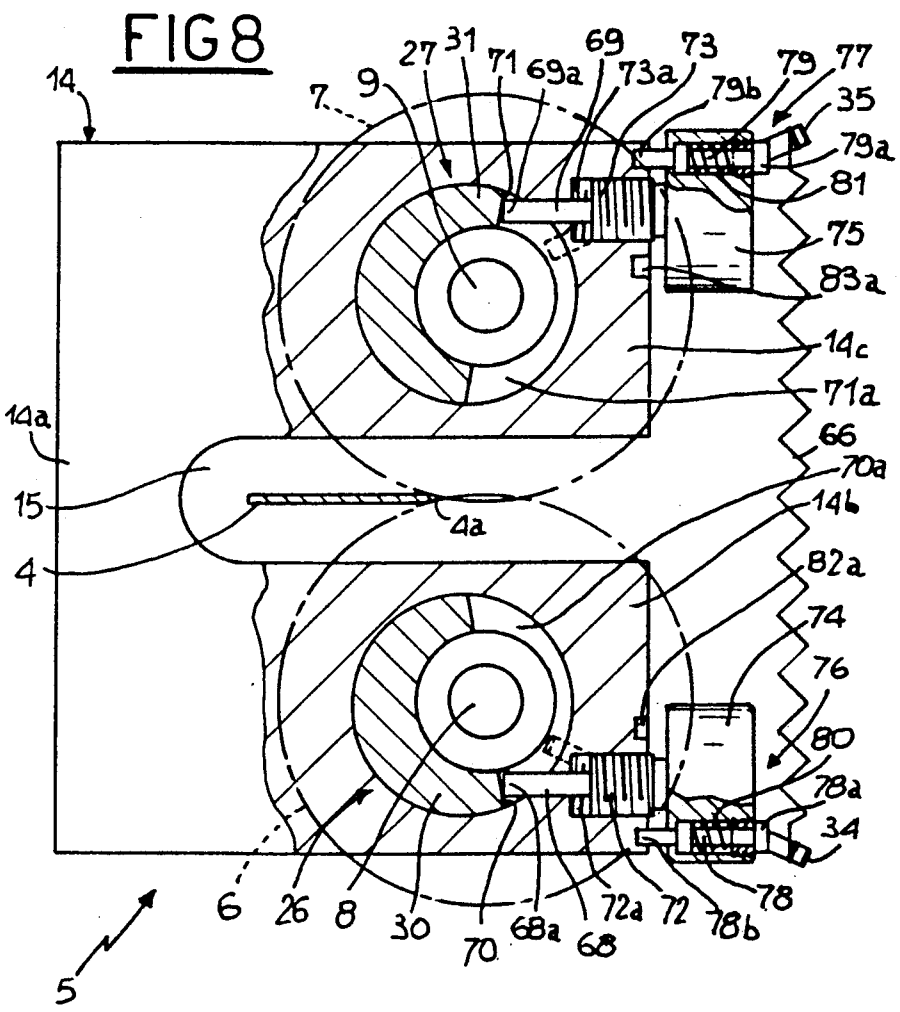
FIG. 8 shows the same sharpening unit cut away in the same manner as in FIG. 6, in which the grinding wheels are however disposed in a different work condition.
Figure 6:
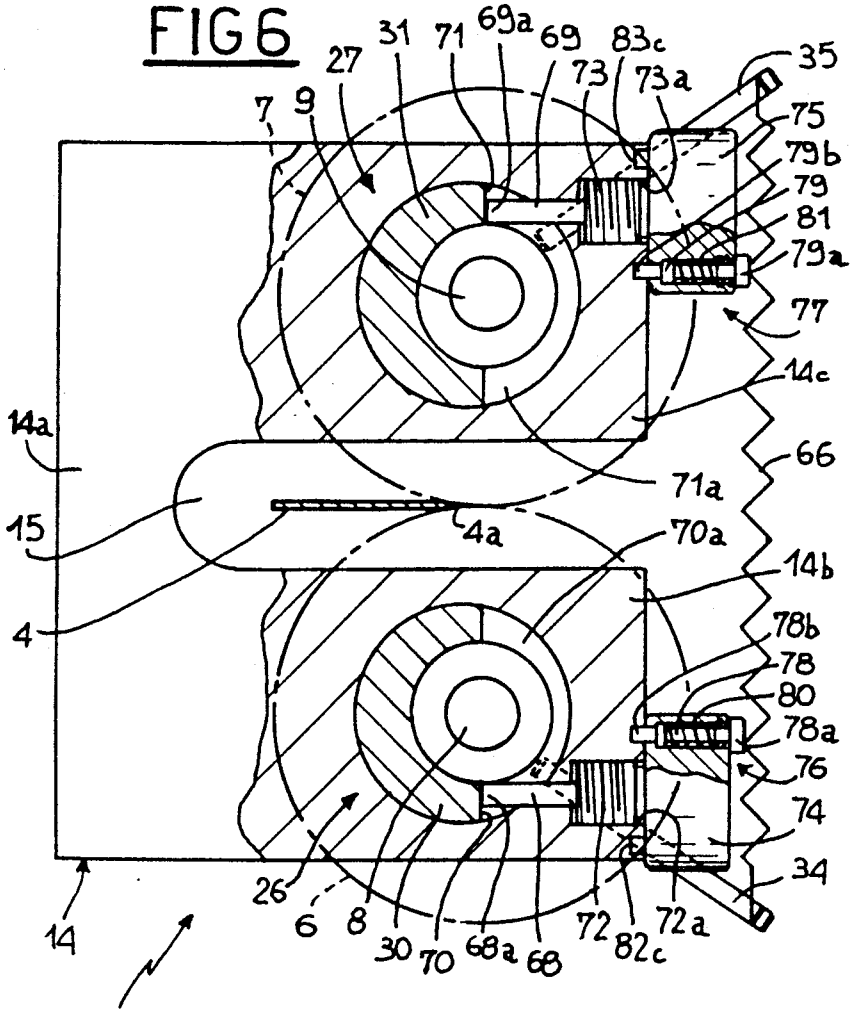
FIG. 6 diagrammatically shows a second embodiment of the sharpening unit partly cut away according to a plane transverse to the cutting blade, in which it is clearly shown the means for the rapid positioning of the grinding wheels which are located in a first work condition.

In the embodiments shown in FIGS. 6, 7 and 8 the stop means on the contrary comprises a pair of stop pins 68, 69 each of them extending through the carriage 14, according to an axis substantially at right angles to and sideways offset from one of the shafts 8, 9 supporting the grinding wheels 6, 7. Each stop pin 68, 69 has one end 68*a*, 69*a* designed to abut against a locating housing 70, 71 formed in the corresponding eccentric bush 30, 31, in order to stop the bush rotation, acting against the action of a pulling spring 66 or equivalent spring means. The spring 66 tends to move the grinding wheels 6, 7 closer by acting upon the ends of levers 34, 35. Preferably each locating housing 70, 71 substantially consists of a groove 70*a*, 71*a* formed at right angles to the axis of rotation of the corresponding eccentric bush 60, 61.

The stop pins 68, 69 are supported in coaxial relation by respective threaded shanks 72, 73 operatively engaged in corresponding threaded housings 72*a*, 73*a* formed in the carriage 14. Each shank 72, 73 is also fixedly engaged with an adjusting handle 74, 75 hand-operable in rotation to modify the axial positioning of the corresponding stop pin 68, 69.

Advantageously locking means 76, 77 is associated with each of the adjusting handles 74, 75. It acts so as to lock the handle to predetermined angular positionings which can be individually selected according to requirements. In greater detail, said locking means 76, 77 preferably comprises, for each handle 74, 75, at least a movable plug 78, 79 slidably engaged through the corresponding handle 74, 75 and constantly submitted to the action of a spring 80, 81 tending to make it protrude from the handle itself at the lower part thereof.

In greater detail, each plug 78, 79 has a gripping end 78*a*, 79*a* projecting from the upper part of the respective handle 74, 75 and a fitting-in end 78*b*, 79*b* projecting from the lower part of said handle. The fitting-in end 78*b*, 79*b* is adapted to selectively engage in at least two holes provided on the base, to lock the handle 74, 75 according to as many angular positionings. In the example shown associated with each plug 78, 79 are three holes 82*a*, 82*b*, 82*c*, 83*a*, 83*b*, 83*c* disposed at 90° one from the other to allow the handles 74, 75 to be locked according to three different angular positions.

A peg 84, 85 is also advantageously provided to project radially from each handle 74, 75, which peg is designed to come in abutment against two limit stops 86, 87 fastened to the carriage 14 at diametrically opposed positions to prevent the handle from rotating through more than 180°.

Operation of the sharpening unit according to the invention described above mainly as regards structure, is as follows.

We will start from the condition in which a new blade and/or fresh diamond grinding wheels are mounted on a leather splitting machine.

Figure 4:
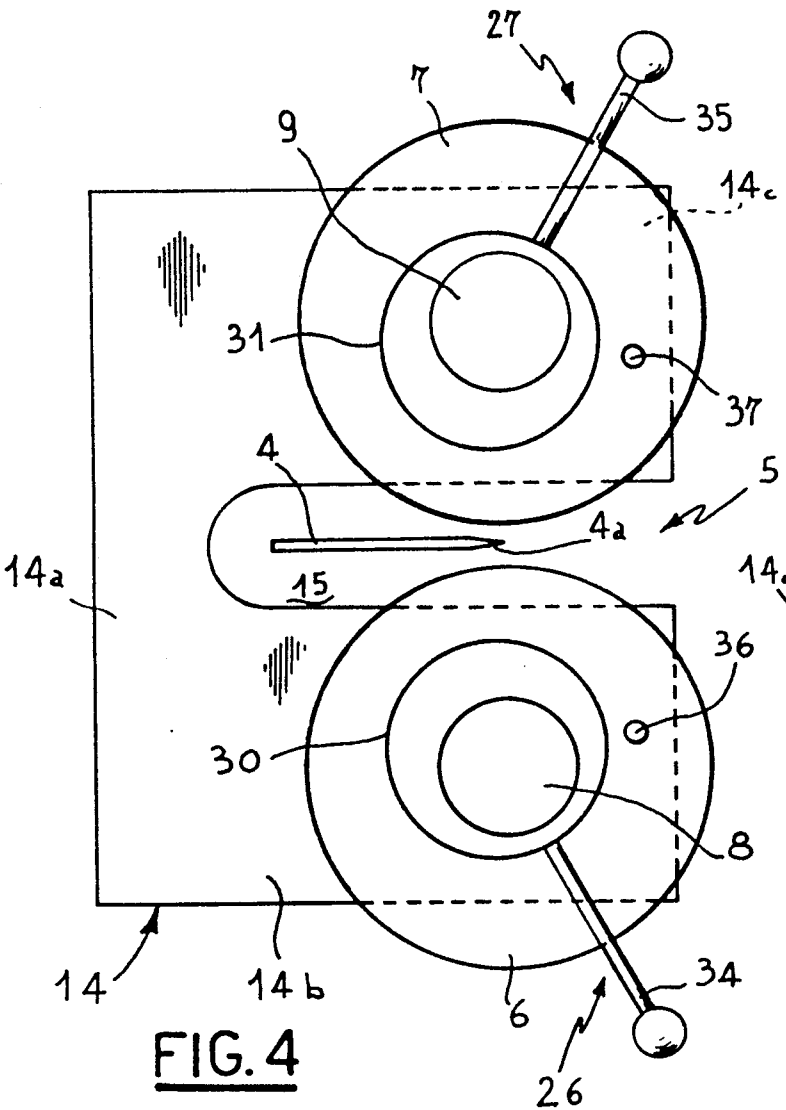
FIG. 4 is a diagrammatic side view of the means for the rapid positioning of the grinding wheels according to the first embodiment, in their opened condition.

Under this situation, the mounting conditions are those viewed in FIG. 4 where the rapid-positioning means is opened. Once the desired mounting has been carried out, levers 34 and 35 are acted upon and the grinding wheels 6, 7 are brought to their work position.

Figure 5:
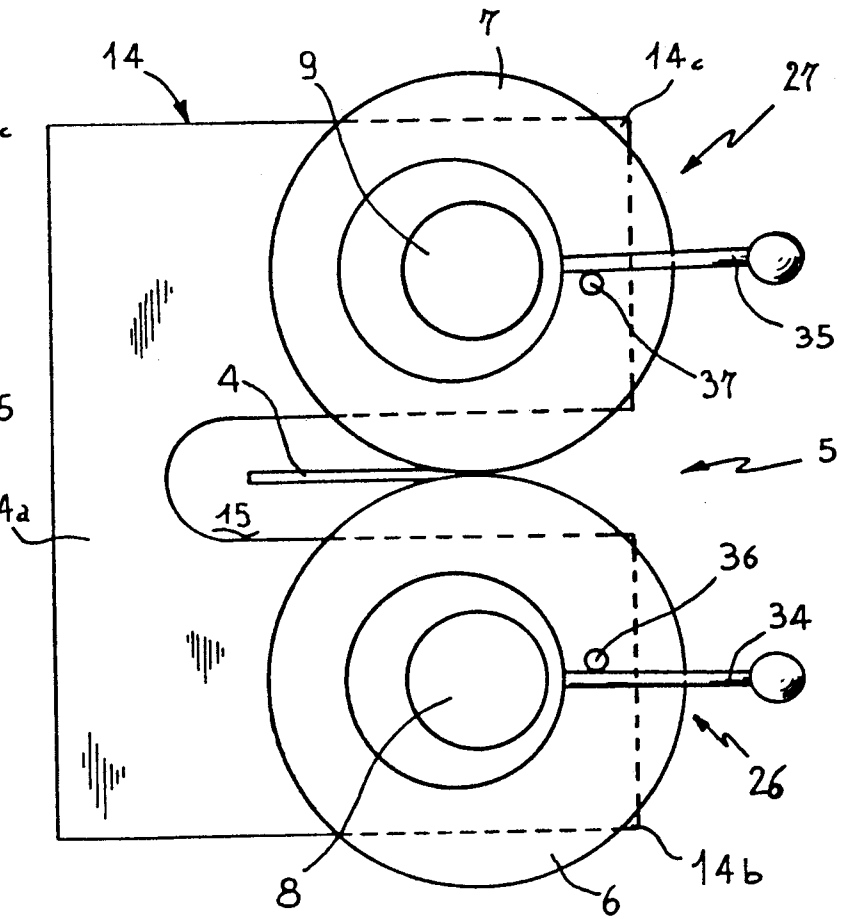
FIG. 5 is a side view of the means for the rapid positioning of the grinding wheels shown in FIG. 4, in their closed condition.

In the embodiment shown in FIG. 5 the work position of the grinding wheels 6, 7 is achieved when levers 34 and 35 abut against the limit locators 36, 37. In the embodiments shown in FIGS. 6, 7 and 8 the grinding wheels 6, 7 are locked to their mutual work positions by means of the stop pins 68, 69 which, abutting against the locating housings 70, 71, work against the action of the pulling spring 66 thus preventing the eccentric bushes 30, 31 from rotating beyond a predetermined limit. In this manner it is possible to ensure the exact mutual positioning of the grinding wheels 6, 7 which, by suitably controlling the displacement of carriage 14, can therefore be brought into contact with the bevel 4*a* and sharpen it continuously while the splitting machine is running.

For shifting carriage 14 it is necessary to act upon knob 38 of the control-adjustment shaft 16. In this way rotations imparted to shaft 16 are transmitted, through idler elements 18 and 19, to the adjusting screw 20 which, by its rotating and abutting against the fixed locator element 22, causes a horizontal displacement of the movable carriage 14 until the grinding wheels 6 and 7 reach the desired position.

Advantageously, the device according to the embodiment shown in FIGS. 6, 7 and 8 also offers the possibility of modifying the mutual positioning of the grinding wheels 6, 7 by acting upon the adjusting handles 74, 75, so as to give different structure and size characteristics to the bevel 4*a*. In fact, in the work conditions seen in FIGS. 6 and 7 where the movable plugs 78, 79 are engaged in holes 82*a*, 83*a*, the grinding wheels 6, 7 are located so that the projections of their profiles are substantially in a tangent relation. Under this situation, the bevel 4*a* is sharpened in such a manner that it exhibits a very elongated configuration, its opposite surfaces diverging according to a very narrow angle. When the bevel 4*a* need to have a shorter configuration, that is a configuration in which its opposite surfaces diverge by a larger angle than in the previous case, the grinding wheels 6, 7 must be slightly moved close to each other so that the projections of their profiles intersect as shown in FIG. 8. To achieve this result it is necessary to act first on the gripping ends 78*a*, 79*a* of plugs 78, 79 to disengage them from holes 82*a*, 83*a*. Then handles 74, 75 are rotated through 180° and locked by fitting the plugs 78, 79 into holes 82*c*, 83*c*. The angular rotation of handles 74, 75 also brings about the rotation of the threaded shanks 72, 73 within their threaded housings. Thus an axial displacement of the stop pins 68, 69 is achieved and the latter will be obliged to move backward from the position shown in FIG. 6.

Due to the displacement of pins 68, 69, the eccentric bushes 30, 31, by effect of the pulling spring 66 are submitted to an angular rotation the amount of which must be sufficient to maintain the locating housings 70, 71 in abutment against said pins. As a result the mutual positioning of the grinding wheels 6, 7 will be modified and brought to the conditions shown in FIG. 8. Obviously when the plugs 78, 79 are engaged in holes 82*b*, 83*b*, the mutual positioning of the grinding wheels 6, 7 will be intermediate relative to the positionings shown in FIGS. 6 and 7. In fact, since the grinding wheels 6 and 7 have not an independent adjustment any longer, but they always hold a fixed mutual positioning, after every interruption of the working cycle which can take place for any reason they are capable of recovering the mutual positioning they originally had at the moment of the initial adjustment.

Obviously, modifications and variations can be made to the device of the invention without departing from the scope of the inventive idea characterizing it.

What is claimed is:

1. A sharpening unit for leather splitting machines comprising a carriage, a pair of diamond grinding wheels disposed symmetrically relative to a bevel of a cutting blade and mounted on respective shafts carried by the carriage, said carriage horizontally movable close to and apart from said cutting blade, a control adjustment shaft provided at one end with a first idler element, said first idler element operatively connected to a second idler element fixedly fitted on an adjusting screw, one end of which is screwed in a threaded hole bored in the movable carriage, whereas the opposite end, thrusted by spring means, abuts against a fixed locator element of the splitting machine, said control adjustment shaft providing simultaneous adjusting of said diamond grinding wheels to a working position close to the cutting blade.

2. A sharpening unit for leather splitting machines comprising a carriage, a pair of diamond grinding wheels disposed symmetrically relative to a bevel of a cutting blade and mounted on respective shafts carried by the carriage, said carriage horizontally movable close to and apart from said cutting blade, a control-adjustment shaft provided at one end with a first idler element, said first idler element operatively connected to a second idler element fixedly fitted on an adjusting screw, one end of which is screwed in a threaded hole bored in the movable carriage, whereas the opposite end, thrusted by spring means, abuts against a fixed locator element of the splitting machine, said control adjustment shaft providing simultaneous adjusting of said diamond grinding wheels to a working position close to the cutting blade, wherein said shafts carrying the grinding wheels are housed in eccentric bushes rotatably supported within respective housings formed in the movable carriage and integrally provided with control levers designed to cause the grinding wheels to rapidly move apart from and close to their working position, through the rotation of said bushes.

3. The sharpening unit as claimed in claim 1, wherein said spring means for urging the adjusting screw against said fixed locator element comprises at least one pulling spring one end of which is fastened to said movable carriage and the opposite end is connected to a fixed casing of the splitting machine.

4. The sharpening unit as claimed in claim 2, further comprising a pair of stop pins each extending along an axis substantially at right angles to and sideways offset from an axis of one of said shafts, one end of each stop pin being designed to act upon a locating housing formed in the corresponding eccentric bush; a pair of threaded shanks each operatively engaging in a threaded housing formed in the carriage and coaxially supporting said stop pins; a pair of adjusting handles each fixed to one of the threaded shanks and operable in rotation to change the axial positioning of the stop pin; locking means associated with said adjusting handles to lock them according to predetermined angular positionings which can be individually selected.

5. The sharpening unit as claimed in claim 4, wherein said locking means comprises a movable plug for each adjusting handle, said plug slidably crosses said handle and individually and selectively engages at least two holes bored in said carriage to fix the angular positioning of said handle.

6. The sharpening unit as claimed in claim 4, further comprising at least one pulling spring acting upon said control levers to cause the rotation of the eccentric bushes to bring the locating housings in abutment against the stop pins.

7. The sharpening unit as claimed in claim 4, wherein each of said locating housings comprises a groove formed in the corresponding bush at right angles to the axis of rotation of the latter.

8. The sharpening unit as claimed in claim 4, wherein each of said adjusting handles is associated with a peg abutting against a pair of limit stops fastened to said carriage at diametrically opposed positions relative to the handle.

* * * * *